United States Patent [19]

Jentschmann

[11] 4,455,955

[45] Jun. 26, 1984

[54] ACCESSORY DEVICE FOR USE ON A SEWING MACHINE

[76] Inventor: Erich Jentschmann, Itenhardstrasse 23b, CH-5620 Bremgarten, Switzerland

[21] Appl. No.: 286,103

[22] Filed: Jul. 22, 1981

[30] Foreign Application Priority Data

Aug. 7, 1980 [CH] Switzerland ..... 5984/80

[51] Int. Cl.[3] ..... D05B 69/22

[52] U.S. Cl. ..... 112/274; 112/300

[58] Field of Search ..... 112/274, 276, 300, 220, 112/221, 275, 277, 285

[56] References Cited

U.S. PATENT DOCUMENTS

| | | | |
|---|---|---|---|
| 1,880,164 | 9/1932 | Whitehouse | 112/274 |
| 3,592,153 | 7/1971 | Margereson | 112/276 |
| 4,080,914 | 3/1978 | Ishida et al. | 112/300 X |

*Primary Examiner*—Peter P. Nerbun

*Attorney, Agent, or Firm*—Pollock, Vande Sande & Priddy

[57] ABSTRACT

The specification relates to accessory device to be used in conjunction with a sewing machine having an automatic thread cutter. The accessory device is provided for enlarging the passageway between the sewing foot and the stitch plate, to enable bulky articles to be moved within said passageway at the time the thread is cut. The device includes a push-back mechanism comprising brake jaws as engaging elements acting upon the drive and mounted on an entrainer operationally connected with an activating device for the purpose of engaging the drive by means of said engaging elements, to push it back and bring the needle bar into its upper position, while the thread feeder remains in its lower position. The obtainable increase in the height of the passageway may be as high as 30%.

13 Claims, 4 Drawing Figures

ACCESSORY DEVICE FOR USE ON A SEWING MACHINE

BACKGROUND OF THE INVENTION

1. Field of the Invention

The invention refers to an accessory device for use on a sewing machine having a thread cutter that performs its cutting in a stop position thereof.

2. Description of the Prior Art

Sewing machines comprising thread cutters are known in the art, such machines being built to make use of positioning motors. The thread cutter is activated in response to a cutting pulse from an associated positioning motor, provided that its position corresponds to a predetermined stop position. The thread cutter does its cutting at a moment in which the thread feeder of the sewing machine has reached its uppermost position. This corresponds to the moment the machine is made to stop to enable the operator to displace or remove the sewn article from under the sewing foot. The kinematics of the motions of the conventional thread feeder and the needle bar is such, that the uppermost position of the thread feeder fails to coincide with the uppermost position of the needle bar. At the moment the thread feeder has reached its uppermost position, the needle bar is well on its downward motion, so that a distance of only 13 to 15 mm remains between the stitch plate and the tip of the needle, i.e. the sewing foot. However, if the sewn goods are thick or bulky the distance required is larger, and to achieve it, the sewing machine must be manually rotated backward by approximately 90°. This, however, is time consuming, unreliable and cannot very well be expected to be performed by the sewing machine operator.

SUMMARY OF THE INVENTION

An object of the invention is to avoid the above-mentioned disadvantages of the known sewing machines and to create an accessory device to be used on sewing machines having thread cutters for enlarging the passageway between the stitch plate and the needle tip, or sewing foot, by approximately 30% subsequent to the thread cutoff operation and to enable the machine operator to more easily and rapidly displace or remove from under the sewing foot those thick or bulky goods which require more room and to do this without any danger of damaging them.

The foregoing and other objects are attained in accordance with one aspect of the present invention by the provision of a push-back mechanism in operational relationship with the drive and comprising drive belt engaging elements, said push-back mechanism being disposed in a region of the sewing machine drive in which the associated needle bar and thread feeder move up and down, said push-back mechanism being operative to push back the drive and raise the needle bar into an upper position thereof as soon as the sewing machine has been brought to a stop and the thread has been cut off.

BRIEF DESCRIPTION OF THE DRAWINGS

Various objects, features and attendant advantages of the present invention will be more fully appreciated from the following detailed description of an embodiment thereof when considered in connection with the accompanying drawings, in which.

DETAILED DESCRIPTION OF THE PREFERRED EMBODIMENTS

Figure 1:
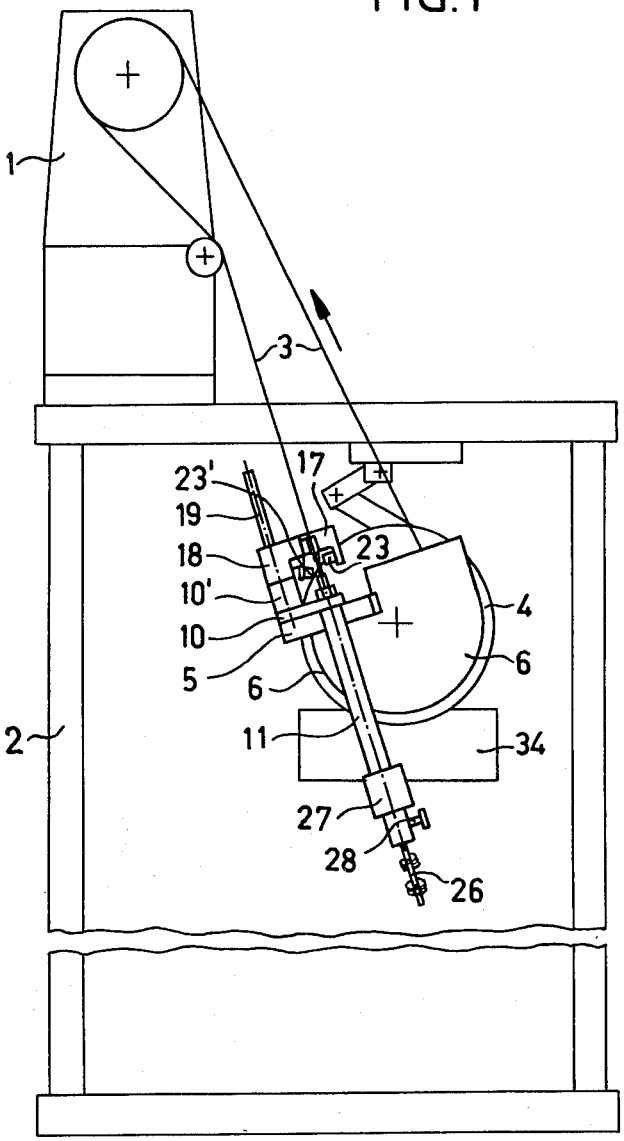
FIG. 1 shows a side view of a sewing machine including the accessory device.
Figure 2:
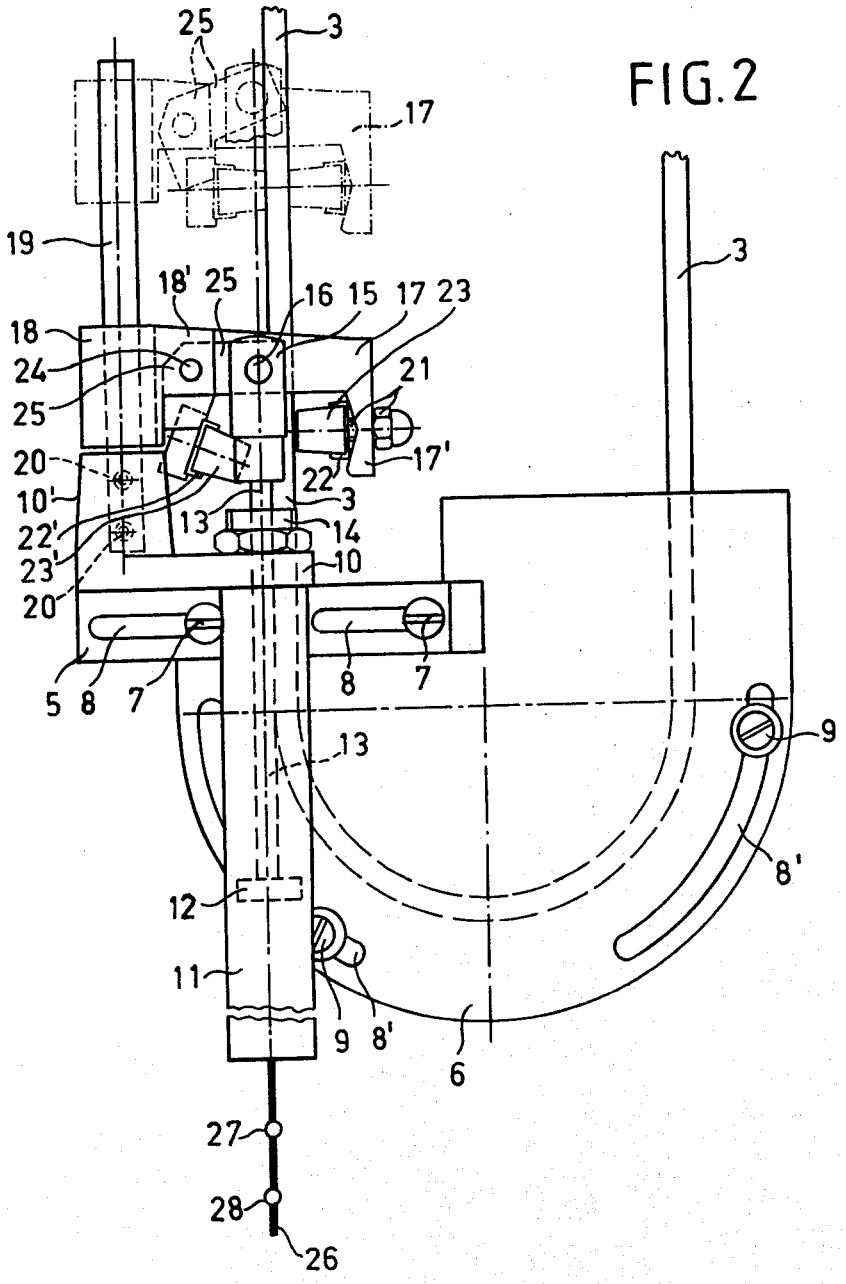
FIG. 2 shows a side view of the accessory device alone, at a larger scale.

An industrial sewing machine of conventional construction is mounted on a table support 2 as designated by 1 in FIG. 1. The machine 1 is driven by the electric motor 4 mounted inside the table support by way of the belt 3. Referring to FIG. 2, the accessory device is fixedly mounted onto a support 5 of the protective hood 6, by means of the screws 7. The screws 7 are displaceable within slots 8 of the support 5, so that the accessory device may be fixedly mounted in any desired position. Slots receiving the fastening screws 9 for fixedly mounting the protective hood 6 on the electric motor are designated by 8'. A beam 10 carrying a downwardly extending pneumatic cylinder 11 rests on the support 5, said cylinder 11 being arranged to accommodate a reciprocating disc piston 12 with a piston rod 13, with the rod being guided through the guide disc 14 upward and to the outside. The upper end of the piston rod 13 comprises a fork head 15 pivotably connected to an entrainer 17 by way of the fork bolt 16. The entrainer 17 is made in one piece with a slider bushing 18, the latter being movable up and down along the guide rod 19. The end portion of the guide rod 19 is fixedly mounted within the extension 10' of the beam 10 by means of the screws 20. The entrainer 17 possesses at its right side a leg 17' projecting downward and carrying on its inner side a metal profile 22 and a brake jaw 23 made of an adhering material and fixedly held by means of a screw 21. The fork-shaped flange 18' of the slider bushing 18 supports the pivot bolt 24 which carries an angular lever 25 mounted to be pivotable in the vertical plane. The horizontal leg of the angular lever 25 is penetrated by the fork bolt 16 and forms a link connection therewith. A second holding profile 22' supporting a second brake jaw 23' is welded to the forwardly protruding left leg of the angular lever 25. In its normal position the belt 3 is disposed between the brake jaws 23, 23' at a distance therefrom. The schematically shown air supply duct 26 communicates with a conventional source of pressurized air not separately shown, and opens into the pneumatic cylinder 11 shown in FIG. 2. An air supply control valve 27 and a throttle 28 for air pressure control are built into the air supply duct 26. The electromagnetic valve 27 receives pulses from a conventional stopping motor 4.

Figure 3:
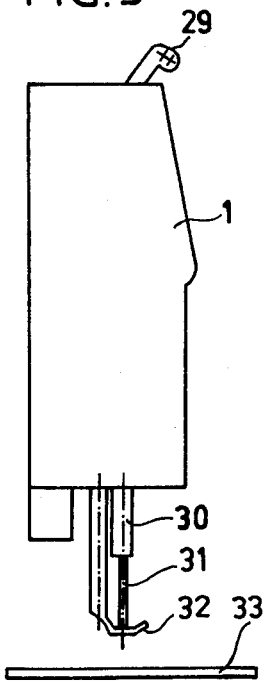
FIG. 3 shows a side view of the needle bar housing of a sewing machine, the thread feeder being in its upper position.
Figure 4:
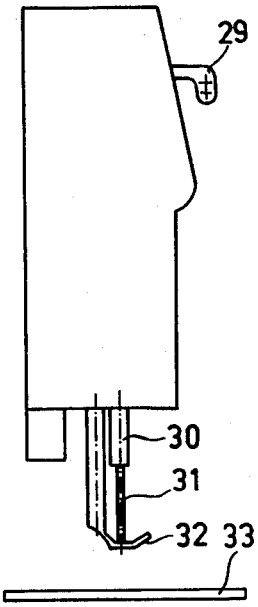
FIG. 4 shows a view similar to the view of FIG. 3, in which the thread feeder is in its lower position, the needle bar and its needle, on the other hand, in their upper positions.

In FIG. 3 the thread feeder 29 of the sewing machine 1 is in its upper position and the reciprocating needle bar 30 and the needle tip 31 occupy their appropriate positions. The sewing foot is designated by 32 and the stitch plate by 33. FIG. 4 shows the thread feeder 29 in its lowest position with the needle bar 30 and its needle 31 in their upper positions. In FIG. 3 the tip of the needle protrudes somewhat beyond the sewing foot 32, which is not the case in FIG. 4. In the position shown in FIG. 3 there is a distance of approximately 14 mm between the stitch plate 33 and the lower bearing surface of the sewing foot, which distance becomes 20 mm in FIG. 4 after the thread feeder 29 is lowered but the needle is raised. This amounts to an increase of 30%.

After the automatic thread cutter has completed its cutoff operation on the sewing machine, the belt 3 is engaged by the brake jaws 23, 23' and pushed back approximately 60 mm by the accessory device described. Immediately following the completed cutoff, the electromagnetic valve 27 receives a pulse from the control means 34 schematically shown in FIG. 1. As a result pressurized air is moved through the conduit 26 into the cylinder 11 resulting in an upward motion of the disc piston 12 and its piston rod 13. The entrainer 17 is moved together with the slider bushing 18 in the longitudinal direction of the guide rod 19 into the position shown in dash-dotted lines (FIG. 2). When the entrainer 17 begins its upward motion the angular lever 25 is rotated in a counterclockwise direction and moves the holding profile 22' together with the brake jaw 23' toward the brake jaw 23. The belt 3 is thereby engaged in a force locking manner, clamped tight, carried along, and pushed back approximately 60 mm. After a certain lapse of time the entrainer 17 returns with the brake jaws 23, 23' into the rest position indicated in FIG. 2 by solid lines and remains there in readiness for the next operation of pushing the belt 3 back. As indicated above, the aim is to hold the needle bar 30 and the needle 31 in their upper positions, while the thread feeder 29 occupies its lower position shown in FIG. 4.

The source of motion energy used in conjunction with the aforedescribed inventional device is pressurized air, which acts by way of the piston rod 13 upon the entrainer 17, the latter being a part of the push-back mechanism. Hydraulic or electrical motion energy could be used instead, of course.

The accessory device may be used in conjunction with any existing sewing machine provided with an automatic thread cutter, for the purpose of enlarging the passageway between the stitch plate 33 and the foot 32, (i.e. the tip of the needle 31, as shown in FIG. 4), so that bulky or thick articles may be moved between the parts 32, 33 with ease and additional manipulations. Obviously, numerous modifications and variations of the present invention are possible in the light of the above teachings. It is therefore to be understood that within the scope of the appended claims the invention may be practiced otherwise than as specifically described herein.

I claim:

1. In a sewing machine having a movable foot, a positioning motor, and a drive belt between the motor and sewing machine, an improvement which comprises:

(a) reciprocating means mounted adjacent said drive belt and aligned to reciprocate in a path parallel to said belt, said reciprocating means comprising longitudinal guide means, entrainer means adapted to reciprocate longitudinally along said guide means adjacent said belt, and drive means for moving said entrainer means along its reciprocal path, (b) belt engagement means mounted on said entrainer means, said engagement means comprising brake jaw means mounted on either side of said belt, said brake jaw means adapted to engage said belt in response to movement of said entrainer means along one direction of its reciprocating path, and (c) control means for energizing said drive means after said motor has reached a predetermined stop position.

2. An improvement for a sewing machine as claimed in claim 1, wherein said brake jaw means comprises a pair of brake jaws with the first of said pair being fixedly mounted on said entrainer means, and the second of said pair being pivotally mounted on said entrainer means.

3. An improvement for a sewing machine as claimed in claim 2, wherein said belt engagement means further comprises a rotatable bell crank mounted to rotate about a pivot point defined on said entrainer means, said bell crank having first and second crank arms with said first arm providing a mount for said pivotably mounted brake jaw and said second arm providing a mount for said drive means.

4. An improvement for a sewing machine as claimed in claim 1, wherein said drive means further comprises a compressed air motor means.

5. An improvement for a sewing machine as claimed in claim 1, wherein said drive means further comprises a hydraulic motor means.

6. An improvement for a sewing machine as claimed in claim 1, wherein said drive means further comprises an electrical motor means.

7. An improvement for a sewing machine as claimed in claim 1, wherein the improvement is mounted on a belt guard which guards a portion of said drive belt.

8. In a sewing machine having a vertically reciprocating thread feeder, a vertically reciprocating sewing needle, a positioning motor and a drive belt between said motor and the sewing machine, said motor driving said drive belt and said sewing machine in a forward direction, an improvement which comprises:

(a) reciprocating means mounted adjacent to said drive belt, said reciprocating means aligned to reciprocate in a path parallel to said belt, (b) belt engagement means mounted on said reciprocating means, said belt engagement means adapted to engage said belt and move said belt in a backward direction upon movement of said reciprocating means along one direction of its reciprocating path, said backward belt movement causing backward movement of the sewing machine so as to raise said sewing needle while lowering said thread feeder, (c) drive means for moving said reciprocating means along its reciprocal path, and, (d) control means for energizing said drive means after said motor has reached a predetermined stop position with the tip of said needle lower than its uppermost position.

9. An improvement for a sewing machine as claimed in claim 8, wherein backward movement of said belt engagement means is sufficient to rotate said sewing machine backward by approximately 90°.

10. An improvement for a sewing machine as claimed in claim 8, wherein said belt engagement means further comprises brake jaw means mounted on either side of said belt, said brake jaw means adapted to engage said belt in response to reciprocation of said reciprocating means.

11. An improvement for a sewing machine as claimed in claim 10, wherein said reciprocating means comprises longitudinal guide means and entrainer means adapted to reciprocate longitudinally along said guide means adjacent to said drive belt, and in which said drive means moves said entrainer means along its reciprocal path.

12. An improvement for a sewing machine as claimed in claim 11, wherein said belt engagement means comprises a pair of brake jaws with the first of said pair being fixedly mounted on said entrainer means and the second of said pair being pivotally mounted on said entrainer means.

13. An improvement for a sewing machine as claimed in claim 12, wherein said belt engagement means further comprises a rotatable bell crank mounted to rotate about a pivot point defined on said entrainer means, said bell crank having first and second crank arms with said first arm providing a mount for said pivotally mounted brake jaw and said second arm providing a mount for said drive means.

* * * * *